United States Patent [19]

Viklund

[11] 4,295,693

[45] Oct. 20, 1981

[54] KNOCKED-DOWN CABINET

[75] Inventor: Ake E. Viklund, Säffle, Sweden

[73] Assignee: Aktiebolaget Electrolux, Stockholm, Sweden

[21] Appl. No.: 94,181

[22] Filed: Nov. 14, 1979

[30] Foreign Application Priority Data

Apr. 9, 1979 [SE] Sweden ..... 7903119

[51] Int. Cl.[3] ..... A47B 43/00

[52] U.S. Cl. ..... 312/257 R; 312/257 SM; 312/257 A; 312/263; 211/135

[58] Field of Search ..... 312/257 R, 257 SK, 257 SM, 312/257 A, 263; 211/135, 183

[56] References Cited

U.S. PATENT DOCUMENTS

| | | | |
|---|---|---|---|
| 455,280 | 6/1891 | Emerson | 312/257 R |
| 459,697 | 9/1891 | Atkinson | 312/257 R |
| 1,068,676 | 7/1913 | Lipsich | 312/263 |
| 1,806,610 | 5/1931 | Christensen | 312/263 |
| 1,821,668 | 9/1931 | Ross | 312/257 R |
| 2,188,602 | 1/1940 | Hall | 211/135 |
| 2,332,299 | 10/1943 | Cohn | 312/257 R |
| 2,522,097 | 9/1950 | Cookson | 211/183 |
| 3,623,784 | 11/1971 | Neufeld | 312/263 |
| 4,077,686 | 3/1978 | Bukaitz | 312/257 R |
| 4,173,379 | 11/1979 | Van der Heiden et al. SM | 312/257 |

FOREIGN PATENT DOCUMENTS

| | | | |
|---|---|---|---|
| 643261 | 6/1962 | Canada | 211/135 |
| 2386965 | 8/1977 | France | 312/263 |
| 630417 | 10/1949 | United Kingdom | 312/257 R |
| 1048108 | 11/1966 | United Kingdom | 312/263 |
| 1162774 | 8/1969 | United Kingdom | 312/263 |

*Primary Examiner*—Victor N. Sakran
*Attorney, Agent, or Firm*—Alfred E. Miller

[57] ABSTRACT

A cabinet having a rear wall, two side walls and a frame-shaped front wall to form a box-like structure. The adjoining edges of the side walls and rear wall are formed in such a manner that they can be interconnected together without the use of fastening means, and wherein the walls are prevented from separation. The walls are so constructed that the cabinet which is formed allowing outer walls in which the outer surface are in a common plane. The interconnected portions on the interior of the cabinet are so constructed that portions thereof serve as means for receiving shelf supports. A part of the rear wall has an edge which is inwardly bent and adapted to slide in a groove formed by a bent edge portion of one of said side walls.

5 Claims, 8 Drawing Figures

Fig. 2.
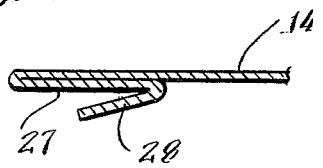
Fig. 3.
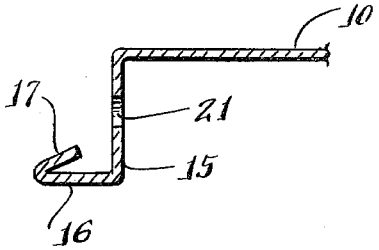
Fig. 4
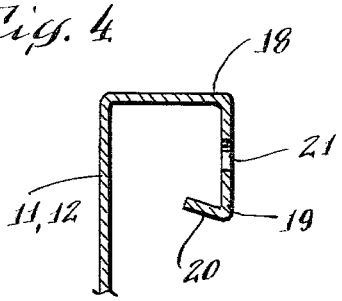
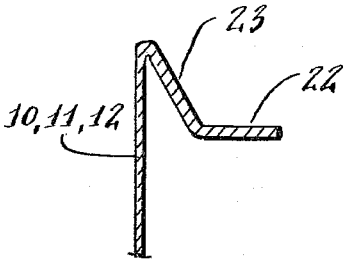
Fig. 5.
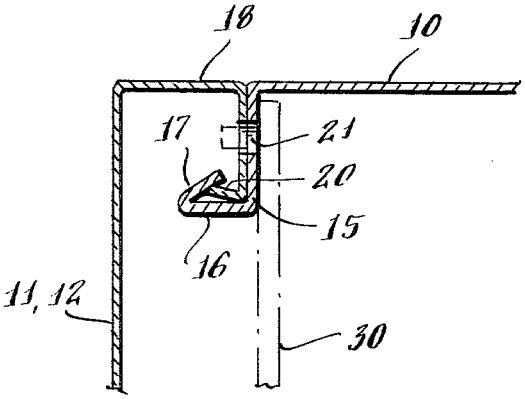
Fig. 6.
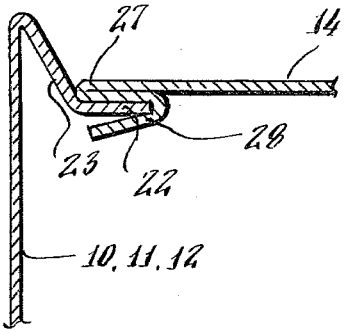
Fig. 7.
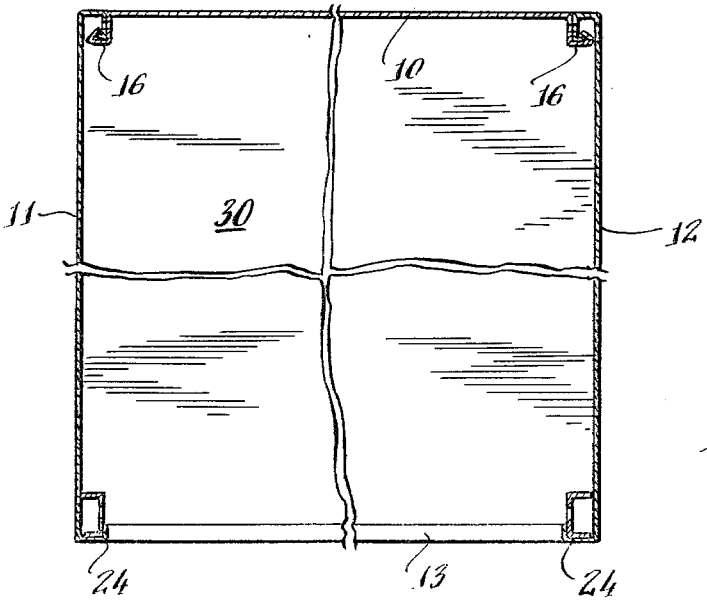
Fig. 8.

KNOCKED-DOWN CABINET

BACKGROUND OF THE INVENTION

The present invention relates to a cabinet, for example, fabricated of sheet metal, in which an edge of a side wall and an edge of a rear wall are joined together in such a manner that on pivoting they engage with one another to form a joint which prevents separation of said walls.

Cabinets of the above description are known, however cabinets of this type is that the parts thereof engaging with one another form a projecting portion so that the handling of the closet is rendered difficult, and it is also difficult to place several closets in a row in a plane relationship.

An object of the present invention is to provide a cabinet which has an even planar outer surface, and does not require separate means for mounting shelf supports.

Another object of the present invention is to provide a cabinet which can be assembled without fastening means so that the same can be shipped unassembled. In addition, the present device has good strength characteristics and is reliably effective for the purposes intended.

In order that the invention will be more clearly understood, it will now be disclosed in greater detail with reference to the accompanying drawings, in which:

FIG. 2 is a sectional view taken along the lines 2—2 of FIG. 1;

FIG. 3 is a sectional view taken along the lines 3—3 of FIG. 1;

FIG. 4 is a sectional view taken along the lines 4—4 of FIG. 1;

FIG. 5 is a sectional view taken along the lines 5—5 of FIG. 1;

FIG. 6 is a section through the side walls and rear walls taken upon assembly of the elements of the invention shown in FIG. 1;

FIG. 7 is a section taken through the top and side wall of the assembled cabinet; and FIG. 8 is a horizontal sectional view as seen in top plan of said assembled cabinet.

DESCRIPTION OF THE PREFERRED EMBODIMENT

Figure 1:
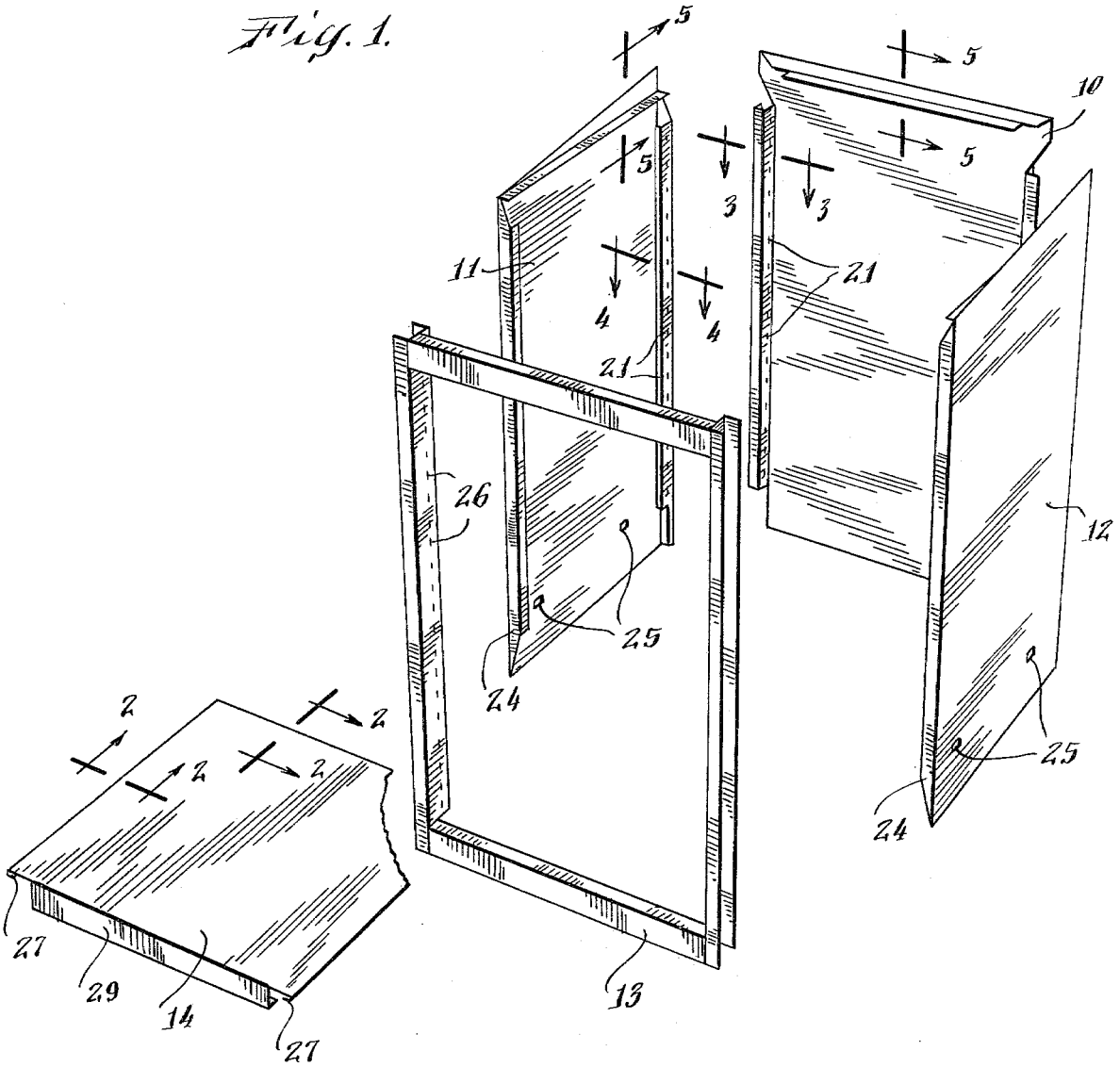
FIG. 1 is an exploded view of the cabinet constructed in accordance with the teachings of the present invention.

As seen in the drawings, the cabinet comprises a rear wall 10, two side walls 11 and 12, and a frame-shaped front wall 13, all of which can be snapped together and interconnected to form a stable box-like cabinet structure. The cabinet further illustrates a top part 14 which may be slid on top of the other sections 10, 11, 12 and 13 and interconnected therewith to form a stable top work surface. The cabinet is also provided with a bottom part (not shown) and several shelves (not shown) which can be hooked into spaced holes 26 in the front of the cabinet, as well as into apertures 21 on the rear and side walls of the cabinet. It should be noted that the rear wall 10 is symmetrical with respect to a vertical central line, and has vertical edges 15, as shown in FIG. 3, extending at an angle of approximately 90° to the vertical plane of the wall in a direction toward the interior of the cabinet. The edges 15 are provided with outer portions 16 which are bent through 90° in an opposite direction to the aforementioned edges. Each end of the portions has a part 17 with a reverse bend.

Referring to FIG. 4, it should be noted that each side wall 11 and 12 has a rear portion 18 located at an angle of 90° to the plane of the side wall and intended, when assembled, to form a continuation of the rear wall 10. Furthermore, the portion 18 has a part 19 that is again bent through 90°, and this part is bent in the same direction as the corresponding rear portion. The latter part terminates in a bent edge part 20. It should be observed that the angle between the bent edge and the bent part 19 is approximately 80°. The edge 20, when assembled is intended to coact with the V-shaped groove formed between one bent part 17, and the respective outer portion 16 of the rear wall 10, as seen in FIG. 6.

Furthermore, as seen in FIG. 6, both edges 15 of the rear wall 10 and the bent parts 19 of the side walls 11 and 12 are provided with apertures 21 which are aligned when the parts are assembled, and whereby shelf supports are to be mounted. As seen in FIG. 7, the upper edge of the rear wall 10 is provided with a horizontal portion 22 which is bent from a part 23 projecting above the top part 14 forming the work surface. Furthermore, each side wall 11 and 12 has a portion corresponding to the horizontal portion and to the projecting part of the rear wall, but the projecting part of each side wall is triangular in configuration and its height increases from the front to the rear of the cabinet.

Referring now to FIG. 1, it should be observed that the vertical front edges 24 of the side walls 11 and 12 are generally U-shaped to enclose the slightly smaller vertical portions of the frame-shaped front wall 13. Furthermore, each side wall in its lower part is provided with struck out portions or lugs 25 to support a bottom part (not shown).

The frame-shaped front wall 13 is constructed to support a door (not shown) of a cabinet has several apertures 26 spaced from each other for a series of horizontal shelves arranged vertically. Along the three edges of top part 14, a portion 27 is bent through 180° as seen in FIG. 2, and terminates by an oppositely directed bent portion 28 so that a groove is formed between the two bent portions. The front edge of the top part 14 has a bent U-shaped part 29 which is adapted to snap-over and enclose the upper horizontal part of the front wall 13 (FIG. 1).

The cabinet is assembled in the following manner: The rear wall 10 and the side walls 11 and 12 are abutted together so that the edges will be inserted into the grooves between the bent portion 17 and the outer portion 16. Thereafter, the side walls are turned or rotated outwardly relative to the rear wall, and will thus secure the walls relative to one another.

Thereafter, the front wall 13 in the form of a frame has its vertical sides inserted over the vertical front edges 24 of the side walls 11 and 12, respectively, said front wall 13 is further secured relative to the other parts of the cabinet by means of shelf supports 30, as shown in FIG. 6. Thus, the shelf supports also secure the side walls and the rear wall against vertical displacement.

The top part 14 is then inserted over the front wall, side walls and rear wall of the cabinet and this is accomplished by pushing said top from the front over the horizontal portions 22 of the side walls 11 and 12, as well as the rear wall 10, and the bent U-shaped portion 29 at the front of the top part is finally inserted over the upper part of the front wall 13 to enclose the same. Thereafter, the bottom part and shelves, if any, can be mounted in the cabinet. In addition, a hinged door, not shown, may be inserted in the front wall 13 of the cabinet to enclose the entire structure.

Referring to FIG. 8, the vertical front edges of the side walls 11 and 12 are shown as U-shaped channels 24 that grasp the side vertical posts of the frame-shaped front wall 13. Furthermore, the placement of the structure shown in FIG. 5 is clearly seen in the upper left and right corners of the cabinet shown in section in FIG. 8. Thus, it should be apparent that the entire cabinet can be assembled without the use of securing means, and when assembled forms a rigid durable work cabinet.

The present invention shows one embodiment, however it should be recognized that other modifications of the present invention can be made within the scope of the following claims.

What is claimed is:

1. A cabinet which is assembled without the use of fastening means and having a rear wall, two side walls, and a frame-shaped front wall which are all interconnected to form a box-like structure, the adjacent edges of said rear and side walls having bent portions which upon abutment and pivoting hook one another to form a joint which prevents separation of said side walls and rear wall wherein said adjacent edges of said rear wall and side walls are bent to extend generally vertically to said rear wall and abut each other, aligned apertures in each of said generally vertical edges, and shelf supports having means for insertion through said apertures in order to lock said rear and side walls together, said rear wall having an edge which is generally bent at right angles to the plane of said rear wall and which projects into the interior of the cabinet, an outer portion of said edge having a reverse bend, said adjacent side walls having a bent edge which is inserted in a groove formed between said outer portion of the edge of said rear wall and the reverse bend portion, and a portion intermediate said bent edge and said side wall which forms an extension to said rear wall and is coextending therewith to form an outer even surface of the rear wall of said cabinet, and a top part having opposite edge portions that are bent at an angle to said top part and are adapted to slide over adjacent edges of said side walls and interconnect with said frame-shaped front wall, and rear and side walls.

2. A cabinet as claimed in claim 1 wherein the outer portion of said rear wall is bent in an opposite direction to the intermediate edge portion of said wall.

3. A cabinet as claimed in claim 2 further comprising a free end portion of said outer portion that is bent substantially in the same direction as said outer portion.

4. A cabinet as claimed in claim 1 wherein the free end portion of said side wall extends parallel to said rear wall, and is bent generally perpendicularly to the plane of said side wall.

5. A cabinet as claimed in claim 1 wherein the angle between the bent edge and the bent portion of said second wall is less than 90°.

* * * * *